US009125530B2

(12) United States Patent
Vargo

(10) Patent No.: US 9,125,530 B2
(45) Date of Patent: Sep. 8, 2015

(54) PORTABLE FOOT SHOWER

(76) Inventor: Greg Andrew Vargo, Harper Woods, MI (US)

( * ) Notice: Subject to any disclaimer, the term of this patent is extended or adjusted under 35 U.S.C. 154(b) by 97 days.

(21) Appl. No.: 12/986,919

(22) Filed: Jan. 7, 2011

(65) Prior Publication Data

US 2012/0174313 A1 Jul. 12, 2012

(51) Int. Cl.

| | |
|---|---|
| ***A47K 3/022*** | (2006.01) |
| ***A47K 3/32*** | (2006.01) |
| ***A47K 7/02*** | (2006.01) |

(52) U.S. Cl.

CPC ..... *A47K 3/325* (2013.01); *A47K 7/026* (2013.01)

(58) Field of Classification Search

USPC ..... 4/615, 622, 602, 605, 616

See application file for complete search history.

(56) References Cited

U.S. PATENT DOCUMENTS

| | | | | | |
|---|---|---|---|---|---|
| 1,936,398 | A * | 11/1933 | Kienle | 4/622 |
| 2,274,739 | A * | 3/1942 | Rast | 4/622 |
| 2,988,754 | A * | 6/1961 | Misson | 4/622 |
| 3,925,830 | A * | 12/1975 | Delaney | 4/615 |
| 4,075,457 | A | 2/1978 | Williams | |
| 5,367,720 | A | 11/1994 | Stephens | |
| D387,173 | S | 12/1997 | Jeans | |
| D450,128 | S | 11/2001 | Dawson | |
| 6,505,358 | B2 * | 1/2003 | Ferber et al. | 4/622 |
| 6,618,870 | B2 * | 9/2003 | Farias | 4/605 |
| 6,668,842 | B1 * | 12/2003 | Wilke et al. | 134/44 |
| 6,931,675 | B1 | 8/2005 | Hager | |
| 2009/0172873 | A1 * | 7/2009 | Ludlow et al. | 4/506 |
| 2010/0043137 | A1 * | 2/2010 | Zavan | 4/622 |

* cited by examiner

*Primary Examiner* — Lauren Crane

(74) *Attorney, Agent, or Firm* — Weiner & Burt, P.C.; Irving M. Weiner; Pamela S. Burt

(57) ABSTRACT

A portable foot shower as disclosed comprising a base member for supporting the user's feet and an operably interconnected swivel shower spray head for washing dirt and particulate from the user's feet through a plurality of slots in the base. The portable foot shower includes a water dispensing assembly with dual top push actuators operated by the toes of the user for controlling the starting, running, and stopping of water from a suitable source. The swivel spray shower head is interconnected with a water regulator assembly through which a water sources rate of flow is regulated.

1 Claim, 4 Drawing Sheets

PORTABLE FOOT SHOWER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Invention

The present invention relates generally to a novel and unique portable foot shower.

More particularly, the present invention relates to a novel and unique portable foot shower having a water dispensing assembly with dual top push actuators thereon for controlling a swivel shower spray head thereon.

2. Prior Art

For a long time, there has been a need for a simple and inexpensive device for cleaning and washing feet prior to entering swimming pools, houses, cottages, campers, RV's, etc.

The prior art is exemplified by: Hager U.S. Pat. No. 6,931,675 B1 entitled "FOOT WASHER"; Stephens et al. U.S. Pat. No. 5,367,720 entitled "FOOT WASHER APPARATUS"; Williams U.S. Pat. No. 4,075,457 entitled "PEDICURE TREATMENT UNIT"; Jeans U.S. Design Pat. No. 387,173 entitled "PORTABLE FOOT WASHER"; and Dawson U.S. Design Pat. No. 450,128 entitled "FOOT BATH".

It is a desiradatum of the present invention to provide a novel and unique portable foot shower which avoids the animadversions of the conventional and prior art techniques and conventional devices and techniques.

OBJECTS AND SUMMARY OF THE INVENTION

It is an object of the present invention to provide a portable foot shower for cleaning and/or washing the feet of a user prior to entering swimming pools, houses, cottages, campers, RV's, etc., comprising: a base member for supporting a user's feet; a swivel shower spray head operably interconnected with said base member; a water regulator assembly operably interconnected with said swivel shower spray head and said base member for conveying water to said portable foot shower from a source of water; and said base member being provided with dual top push actuators for controlling starting, running and stopping of water from said swivel shower spray head.

It is a primary object of the present invention to provide a portable foot shower as described hereinabove, wherein said portable foot shower is fabricated from plastic injection mold construction.

Another object of the present invention is to provide a novel and unique foot shower as described hereinabove, wherein said base member comprises a rigid plastic base.

Yet another object of the present invention is to provide a novel and unique portable foot shower as described hereinabove, wherein said portable foot shower being provided with a water dispensing assembly including dual top push actuators thereon.

A further object of the present invention is to provide a portable foot shower as described hereinabove, wherein the base member has a surface simulated wood grain pattern.

A further object of the present invention is to provide a novel and unique portable foot shower as described hereinabove, wherein said portable foot shower has a base member which is approximately 0.762 meters long, and 0.4572 meters wide.

The present invention possesses many advantages and features which will become apparent to those persons skilled in this particular area of technology and to others when having read the detailed description of the exemplary preferred embodiments of the present invention as set forth hereinbelow in conjunction with the accompanying drawings.

Figure 1:
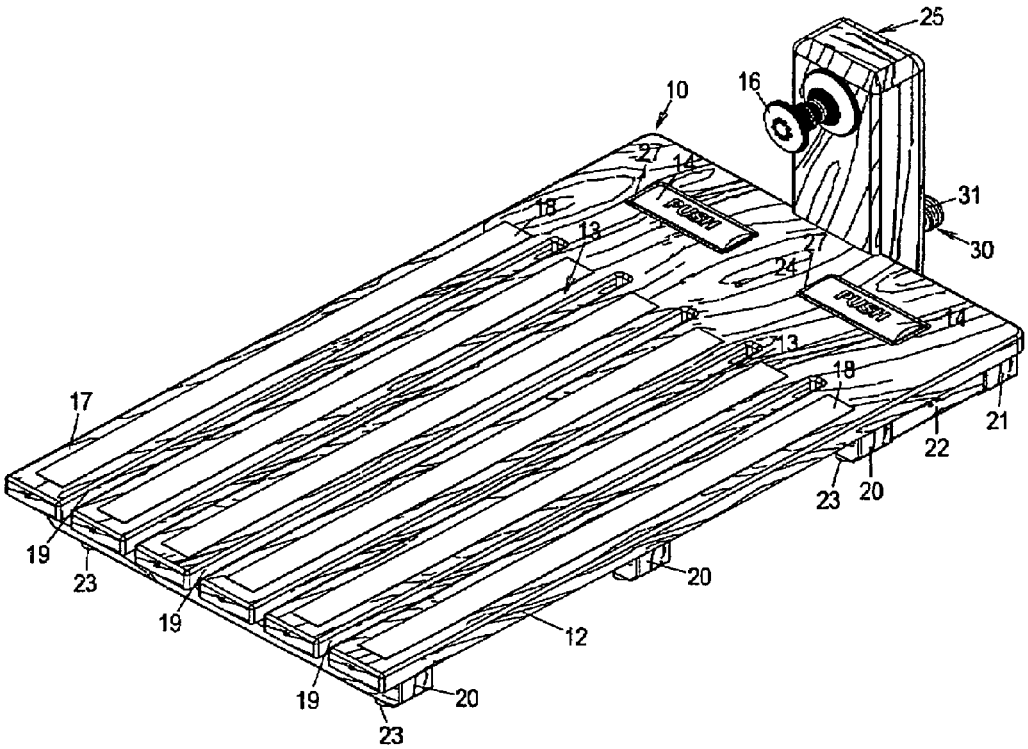
FIG. 1 illustrates a top perspective view of a preferred embodiment in accordance with the present invention.

| DRAWINGS—Reference Numerals | |
|---|---|
| 10 portable foot shower | 11 feet |
| 12 base member | 13 foot placement—areas |
| 14 top push actuator | 15 toes |
| 16 swivel shower spray head | 17 top surface |
| 18 non-slip tape strips | 19 apertures—slots |
| 20 support legs | 21 modified—support leg |
| 22 end cap—closure | 23 rubber bumper feet |
| 24 spray (flow) adjustment aperture | 25 swivel shower head compartment |
| 26 bottom surface | 27 elongated opening |
| 30 water regulator assembly | 31 female garden hose swivel |
| 32 adapter—FIP to MIP | 33 pipe reducer coupling |
| 34 compression connector | 35 water supply tubing |
| 36 compression elbow | 37 regulator holder |
| 38 hex nut | 39 regulator |
| 40 protective housing assembly | 41 protective casing (regulator) |
| 42 thumb screw | 43 regulator mounting bracket |
| 44 shoulder screw | |
| 50 water dispensing assembly | 51 top push bracket |
| 52 pivot block | 53 rivet |
| 54 self-threading nut | 55 push bar |

DETAILED DESCRIPTION OF THE PREFERRED EMBODIMENTS

In the following detailed description of the preferred embodiments, reference is made to the accompanying drawings which form a part hereof, and are shown by way of illustration specific embodiments in which the invention may be practiced. It is to be understood that other embodiments may be utilized and structural changes may be made without departing from the scope of the present invention.

With reference to the drawings, an exemplary preferred embodiment of the present invention is illustrated in FIGS. 1, 2, 3, 4, 5 and 6.

In accordance with the exemplary preferred embodiment of the present invention there is provided a novel and unique portable foot shower 10 for cleaning and/or washing feet 11 prior to entering swimming pools, houses, cottages, campers, RV's, etc.

Figure 3:
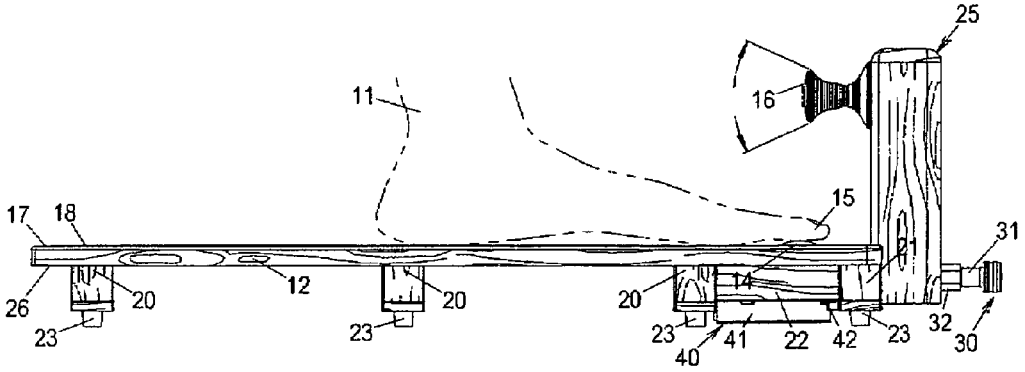
FIG. 3 depicts a side elevation view of a preferred embodiment of the present invention, showing the portable foot shower in use.

With reference to FIGS. 1 and 3, there is shown that the portable foot shower 10 is provided with a base member 12 which preferably, but not necessarily, comprises a rigid plastic base. The base member 12 is provided with two areas 13 for accommodating the left and right feet, respectively, of the user. It should be noted that the top surface 17 of base member 12, has a plurality of non-slip tape strips 18, preferably attached, for the safety of the user. Preferably, but not necessarily, the portable foot shower 10 is provided with dual top push actuators 14 which may be selectively operated by the toes 15 of the user to control the starting, running, and stopping of the water from a swivel shower spray head 16 operably interconnected at one end of the base member 12.

The swivel spray shower head 16 is connected with a suitable water source. Preferably, but not necessarily, this connection is made by way of a female garden hose swivel connection 31, illustrated in FIG. 4.

Figure 2:
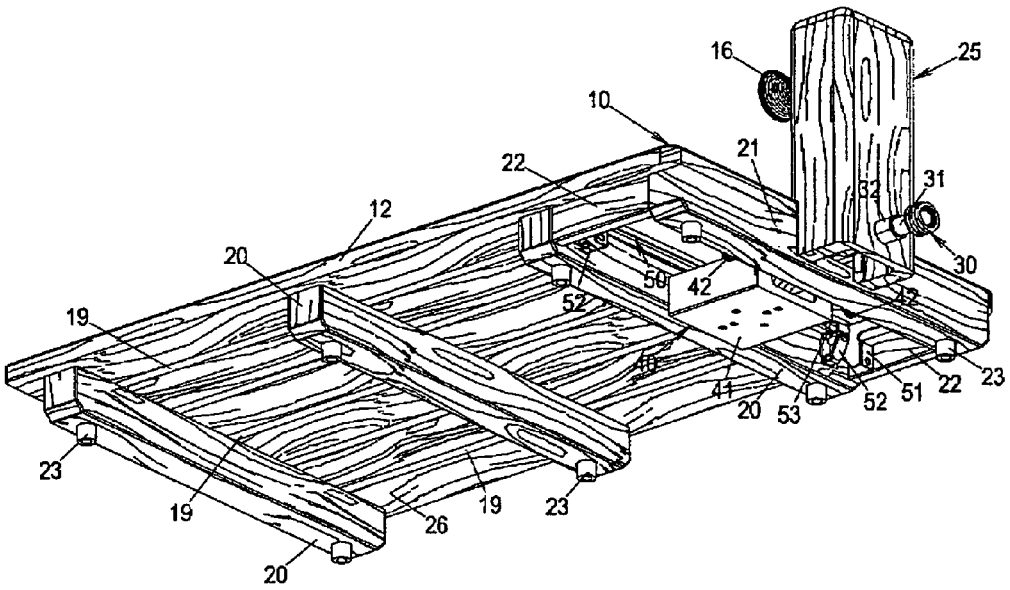
FIG. 2 is a rear perspective view (from below) of a preferred embodiment illustrating the locations of the water regulator, water dispensing, and protective housing assembly components.
Figure 4:
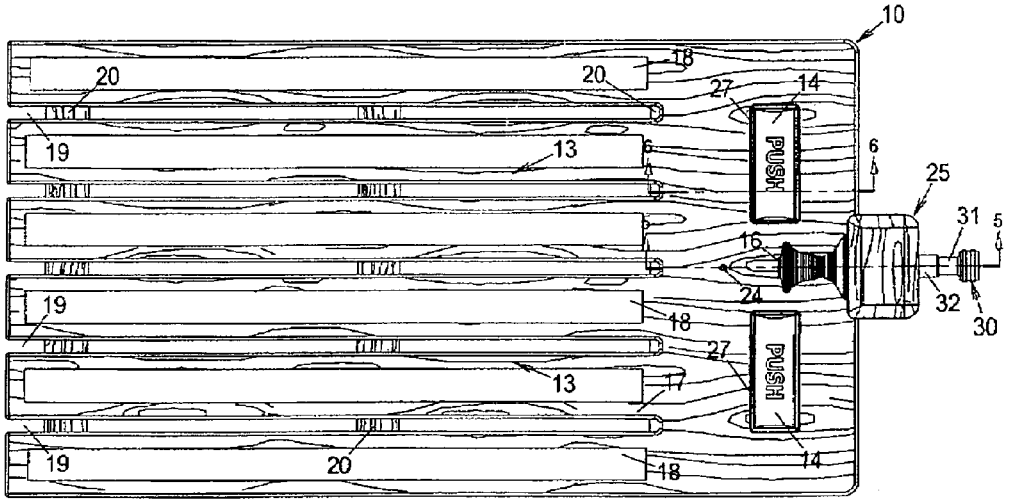
FIG. 4 is a top plan view of the FIG. 1 preferred embodiment of the present invention.

As shown in FIGS. 1, 2, and 4, it should be noted that the base member 12 of the portable foot shower 10 is provided with a series of slots or apertures 19 through which excess water, dirt, and particulate may flow downwardly. In this connection, attention is directed to a plurality of support legs 20, modified-support leg 21, and a pair of end cap-closure 22 provided on the bottom surface 26 of the base member 12. Additionally, affixed to the bottom of support legs 20 and modified-support leg 21, are plurality of rubber bumper feet 23, as especially well seen in FIG. 2. The rubber bumper feet 23 are provided to add stability to the user on suitable flat surfaces.

FIG. 3 illustrates the use of the preferred embodiment in phantom line, a foot 11 of a user pressing down with their toes 15 on one of the dual top push actuators 14 for controlling water from the swivel spray shower head 16.

Figure 6:
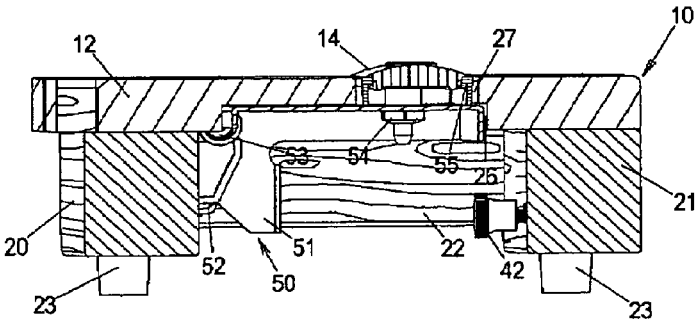
FIG. 6 is a perspective sectional view taken generally on line 6-6, FIG. 4, with some parts shown in elevation, of the preferred embodiment of the present invention.

The portable foot shower 10 of the present invention comprises a water dispensing assembly 50, comprising a top push bracket 51 that is disposed into a mortised cavity of the bottom surface 26 and includes dual laterally spaced top push actuators 14 which project outwardly from the top surface 17 of the base member 12 through disposed elongated openings 27. More particularly, the top push actuators 14 are embedded in a push bar 55, and connect to the top push bracket 51 by means of a self-threading nut 54, as best seen in FIG. 6. The end edges of the top push bracket 51 include parallel wings which are perpendicular to the top push bracket 51 and of unitary construction therewith. Each wing includes an aperture for receiving a rivet 53 for mounting. The top push bracket 51 pivotably connected to the support leg 20 by a pair of pivot blocks 52 and rivet 53 that permit the top push bracket 51 to mechanically pivot downwardly upon the application of manual pressure to said top push actuators 14.

Figure 5:
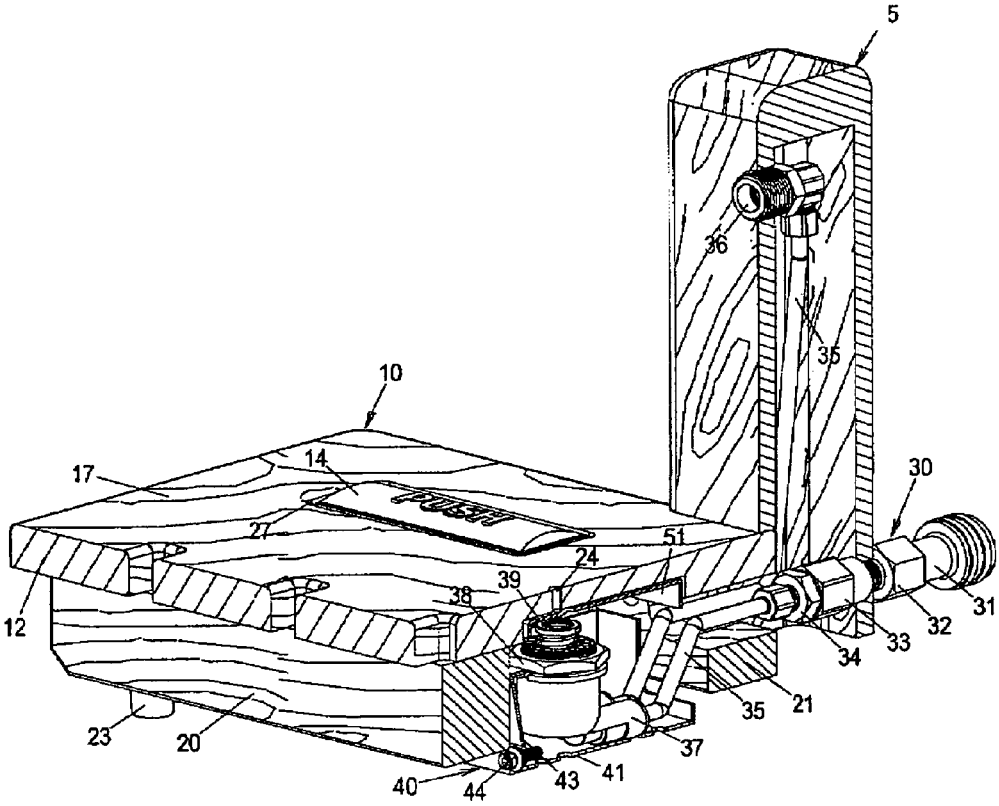
FIG. 5 is a perspective sectional view taken generally on line 5-5, FIG. 4, with some parts shown in elevation and some parts deleted for clarity of illustration.

The water regulator assembly 30 may be of any suitable construction known to those skilled in the art and comprises an actuating regulator 39 which is adapted to cooperate with the central portion of the top push bracket 51 whereupon pivotal or downward movement of the push bar bracket 51 will effect operation of the regulator 39 to effect opening of a flow path between a suitable source of water and the swivel shower spray head 16, as illustrated in FIG. 5.

In accordance with the exemplary preferred embodiment of the present invention, the water regulator assembly 30 includes the regulator 39 comprised of a body and a spring assisted adjustable actuator in the form of a screw threaded member having a large, flat surface head with a screw driver receiving kerf or groove extending diametrically thereof so that the actuator flow can be adjusted. To adjust the position of the regulator 39 a small aperture is provided in the base member 12. In this connection, attention is directed towards a spray (flow) adjustment aperture 24 sufficiently large to receive a screw driver blade which can engage the kerf or groove thereby enabling adjustment of the regulator 39 for varying the flow characteristics from the swivel shower spray head 16, as shown in FIGS. 1, 4, and 5. The regulator 39 is received in a regulator holder 37 associated with the water inlet and outlet. The regulator 39 is retained in the regulator holder 37 aperture by an annular, externally threaded collar and diametrically opposed threaded hex nut 38. Disposed between regulator holder 37 and the hex nut 38 is a regulator mounting bracket 43 fixed thereon the support leg 20, provided on the bottom surface 26 of the base member 12.

Additionally, the water regulator assembly 30 comprises flexible water supply tubing 35 interconnected to the regulator holder 37 water inlet line and water outlet line apertures. The water supply tubing 35 from the regulator holder 37 outlet aperture, passes through the modified-support leg 21 into the swivel shower head compartment 25 and vertically interconnected to a compression elbow 36 terminating in a connection to the swivel shower spray head 16. The water supply tubing 35 from the regulator holder 37 inlet aperture, passes horizontally through the modified-support leg 21 interconnected to a compression connector 34 further interconnected to a pipe reducer coupling 33 which passes through an aperture in the swivel shower head compartment 25 interconnecting to an adapter—FIP to MIP 32 terminating in connection to the female garden house swivel 31.

The portable foot shower 10 further includes a method for protecting the water regulator assembly 30, as best seen in FIG. 6. This is accomplished with the inclusion of a protective housing assembly 40 comprised of a protective casing (regulator) 41 which is preferably, but not necessarily, affixed to the modified-support leg 21 by a pair of thumbs screws 42. Alternately, for alignment purpose, the protective housing assembly 40 is affixed to the regulator mounting bracket 43 by a shoulder screw 44 threaded through an aperture in the regulator mounting bracket 43.

Preferably, but not necessarily, the portable foot shower 10 is constructed by plastic injection molding.

Furthermore, it is preferable, but not necessary, that the base member 12, swivel shower head compartment 25, support legs 20, and modified-support leg 21 be provided with a surface simulated wood grain pattern.

In a typical exemplary embodiment of the portable foot shower 10, the base member 12 as a length of 0.762 meters, a width of 0.4445 meters, a swivel shower head component 25 which extends 0.254 meters above the ground and 0.1905 meters above the top surface 17 of the base member 12, and wherein the swivel shower head component 25 has a width of approximately 0.1016 meters.

The portable foot shower 10 and the various components thereof may be fabricated from any suitable material. Preferably, but not necessarily, such components are fabricated from molded plastic.

In operation, the portable foot shower 10 can be conveniently used in any situation in which it is desirable to clean and/or wash the feet of a user prior to entering swimming pools, houses, cottages, campers, RV's, etc. The base member 12 is placed on a suitable flat surface then the female garden hose swivel connection 31 is connected to a suitable water source. The user steps on said base member 12 locating the feet 11 in the foot placement—areas 13 while positioning the toes 15 over the top push actuators 14. Downward movement by the toes 15 on the top push actuators 14 interconnected with the top push bracket 51 will effect operation of the regulator 39 to effect opening a flow path between the suitable water source and the swivel shower spray head 16 effectively washing the feet 11 of the user while excess water, dirt, and particulate flow downwardly off the base member 12 through a series of slots or apertures. An adjustment to the flow rate of the regulator 39 is provided through a small spray (flow) adjustment aperture 24 in the base member 12 with a screw driver. Release of the downward movement by the toes 15 of the user from the top push actuators 14 interconnected with the top push bracket 51 will effectively stop operation of the regulator 39 and the flow path between the suitable water source and the swivel shower spray head 16. When finished, and because of the portability of the device, the portable foot shower 10 can be conveniently stored until needed, such as in a camper storage compartment or the supply room of a beach/pool house.

There has been illustrated in the accompanying drawings and described hereinabove only one preferred embodiment of the unique and novel portable foot shower in accordance with the present invention, which can be constructed in various different sizes, shapes and materials.

It should be understood that many changes, modifications, variations, and other uses and applications will become apparent to those persons skilled in this particular area of technology and to others having been exposed to the present patent specification and accompanying drawings.

It is therefore intended that the following claims be interpreted as covering any and all such changes, modifications, variations, and other uses and applications which do not depart from the spirit and scope of the present invention are therefore covered by and embraced within the present invention and present patent application.

I claim:

1. A portable foot shower for showering feet of a user, comprising, in combination:

one and only one fixed stationary horizontal base structure having a major central elongated horizontal base axis and a plurality of parallel slots therein which are oriented parallel to said major central elongated horizontal base axis;

said plurality of parallel slots permitting excess water, dirt, and other particulates to pass downwardly therethrough;

one and only one vertical shower structure mechanically and operably connected to said one and only one fixed stationary horizontal base structure;

said one and only one vertical shower structure including one and only one swivel spray shower head and a swivel connector for connecting said one and only one vertical shower structure to a source of water which is remote from the portable foot shower via a garden hose;

said one and only one fixed stationary horizontal base structure providing two areas for supporting and accommodating a right foot and a left foot of the user;

said one and only one fixed stationary horizontal base structure including dual laterally-spaced top push actuators selectively operated by toes of the user for controlling starting, running, and stopping a flow of water to said one and only one vertical shower structure interconnected to said one and only one fixed stationary horizontal base structure;

a plurality of non-slip tape strips attached to a top surface of said one and only one fixed stationary horizontal base structure;

a plurality of support legs, a modified support leg, and a pair of end cap closure members provided on a bottom surface of said one and only one fixed stationary horizontal base structure;

said plurality of support legs and said modified support leg being disposed perpendicular to said parallel slots, said non-slip tape strips; and said major central elongated horizontal base axis of said one and only one fixed stationary horizontal base structure;

a plurality of rubber bumper feet affixed to a bottom surface of said plurality of support legs and said modified support leg;

said dual laterally-spaced top push actuators having their major central elongated axis disposed perpendicularly to said major central elongated base axis of said one and only one fixed stationary horizontal base structure;

one and only one water dispensing assembly including a top push bar bracket disposed in a mortised cavity of said bottom surface of said one and only one fixed stationary horizontal base structure, and said dual laterally-spaced top push actuators which project upwardly from said top surface of said one and only one fixed stationary horizontal base structure;

one and only one spring-assisted adjustable water regulator device for varying water flow to said one and only one swivel shower head which forms part of said one and only one vertical shower structure;

said dual laterally-spaced top push actuators are embedded in a push bar connected to said top push bar bracket which is allowed to pivot downwardly to engage said one and only one spring-assisted adjustable water regulator device for varying water flow to said one and only one swivel shower head which forms part of said one and only one vertical shower structure;

said one and only one fixed stationary horizontal base structure includes an aperture therein for providing access to said one and only one spring-assisted adjustable water regulator device for varying flow of water to said one and only one swivel shower head;

said one and only one swivel shower head is located above said dual laterally-spaced top push actuators and substantially mid-way between said dual laterally-spaced top push actuators;

a protective housing assembly for protecting said one and only one spring-assisted adjustable water regulator device; and said protective housing assembly includes a protective casing which is affixed to said modified support leg.

* * * * *